US006957462B1

(12) United States Patent
Wilcox

(10) Patent No.: US 6,957,462 B1
(45) Date of Patent: Oct. 25, 2005

(54) PILLOW WITH SLIDABLE STRAP THROUGH IT

(76) Inventor: Richard B. Wilcox, 2763 Holly Point Rd. East, Orange Park, FL (US) 32073

( * ) Notice: Subject to any disclaimer, the term of this patent is extended or adjusted under 35 U.S.C. 154(b) by 0 days.

(21) Appl. No.: 10/991,112

(22) Filed: Nov. 17, 2004

(51) Int. Cl.[7] ..... A47G 9/00
(52) U.S. Cl. ..... 5/636; 5/630; 5/644; 297/393
(58) Field of Search ..... 5/636, 630, 639, 5/640, 647, 650, 644; 297/393; D6/601

(56) References Cited

U.S. PATENT DOCUMENTS 3,284,817 A * 11/1966 Landwirth ..... 5/647
D390,405 S * 2/1998 Jung ..... D6/601
5,824,013 A * 10/1998 Allen ..... 606/240
5,860,177 A 1/1999 Jung
6,017,094 A 1/2000 Syiek
6,230,349 B1 5/2001 Silver et al.
D481,247 S 10/2003 Roberts et al.

FOREIGN PATENT DOCUMENTS

GB 2 194 883 * 3/1988
JP 45565 * 6/1994

* cited by examiner

*Primary Examiner*—Alexander Grosz
(74) *Attorney, Agent, or Firm*—Lawrence J. Gibney, Jr.

(57) ABSTRACT

An elongated pillow has an insert through its interior adapted to slidably accommodate a strap which can releasably attach the pillow to a portion of a user's body. The ends of the straps can be releasably attached to each other with various fastener means. The pillow has pouches adapted to store the strap when coiled in a nonuse position. The pillow may be made from foam or may be filled with air.

5 Claims, 3 Drawing Sheets

PILLOW WITH SLIDABLE STRAP THROUGH IT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

On long trips it is sometimes difficult to find a comfortable position, particularly if an individual wants to sleep. The main problem in trying to sleep on a long trip is the support of the head. Often times on long airplane rides a small pillow is used, but the pillow often slips out from under the head and therefore wakes the person up. The same is also true of long car rides.

Additionally, people who have neck problems or have difficulty holding the neck would also benefit from this particular idea in that it would lend support to the neck muscles.

B. Prior Art

There are other travel pillows that attempt to reform the same function, however, these are all performed with substantial differences in the material and/or contour of the pillow.

Example of these other devices are Syiek U.S. Pat. No. 6,017,094 or Jung U.S. Pat. No. 5,860,177, and Silver U.S. Pat. No. 6,230,349.

All travel pillows including this device support the head in some manner or fashion. However, none of the prior relevant art uses an insert or a strap to connect the device to the individual.

This device is very portable and supports the head by using a strap, which extends across the person's body. It can also be adjusted to the individual's body shape and size.

BRIEF SUMMARY OF THE INVENTION

This is a travel pillow, which is contoured to the person's neck and shoulder. Part of the neck will recline against the pillow and be supported by the person's shoulder on the other side. It is anticipated that for comfort reasons the pillow will be manufactured from foam or other soft material. Through the center of the device is an insert, which is probably plastic, through which the strap is treaded. The strap in use will go across the person's body under the arm area and the ends will connect.

A male end and female end for the strap is used to fasten the device across the person's body. The length of the strap may be adjusted depending on body size and shape. A device may be used to hide the strap by covering the strap with decorative fabric.

Additionally, there may be a pad under the armpit of the person for additional comfort or additional padding for women as the strap crosses the chest of the woman.

The pillow is concave in the center to conform to the shape of the person's neck and shoulder. Slight differences in the shape of the concave portions of the pillow may be desirable for maximum comfort. The device will likely be constructed from foam, which will conform the general shape of the person.

When the pillow is not being used the straps are coiled and inserted into storage areas on the sides of the device.

DETAILED DESCRIPTION OF THE EMBODIMENTS

This is a pillow or device 5, which is designed to be contoured to the person to enable a person to sleep on long trips or to support the neck of an individual with neck or shoulder difficulty. The pillow is cylindrical in shape and is constructed from filler material such as foam or other soft pliable material for maximum comfort, which allows the device to conform to the shape of the individual user's body shape. Additionally an inflatable air bladder may also be used in place of the filler material. The use of the inflatable bladder would allow easy storage when traveling. The filler material is contained in a case 10 such as a slip cover.

Figure 1:
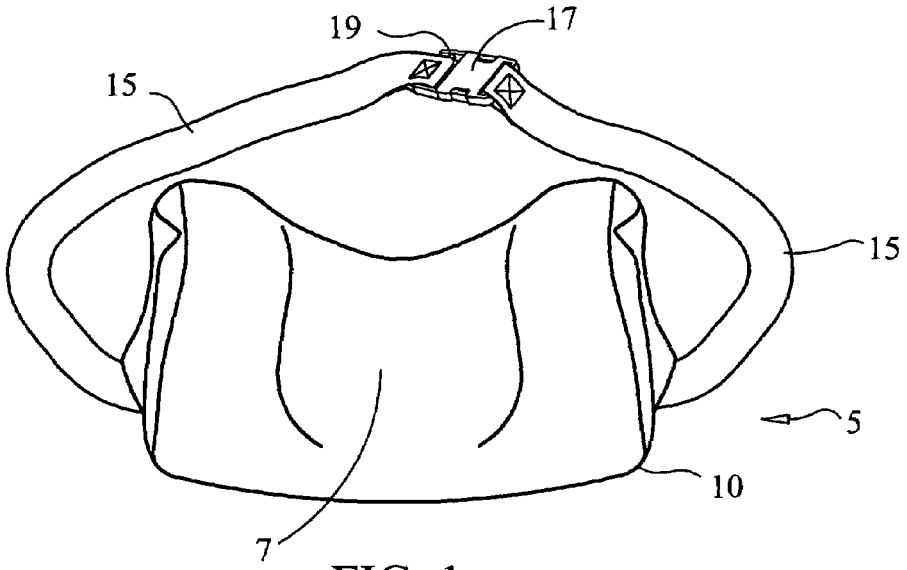
FIG. 1 is an isometric of the device with the strap attached.
Figure 2:
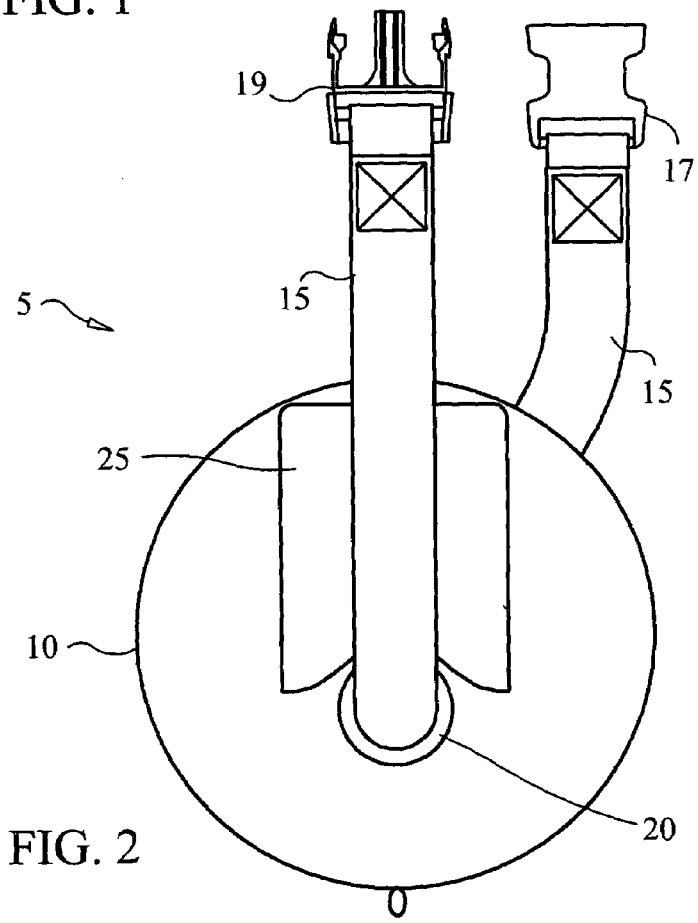
FIG. 2 is a side view of the device with the straps not attached.

The pillow has a contoured section 7 in approximately the middle of the pillow as depicted on FIG. 1. The section is slightly concave so that the section would fit the areas between the person's neck and shoulder. The two outside edges of the device provide a means to secure the device is necessary.

A strap 15, which has a male end 19 and a female end 17 is inserted through the middle of the device.

The male and female ends of the strap 15 could be changed to snaps, buttons, hook and loop connectors, or other separable fasteners.

Figure 3:
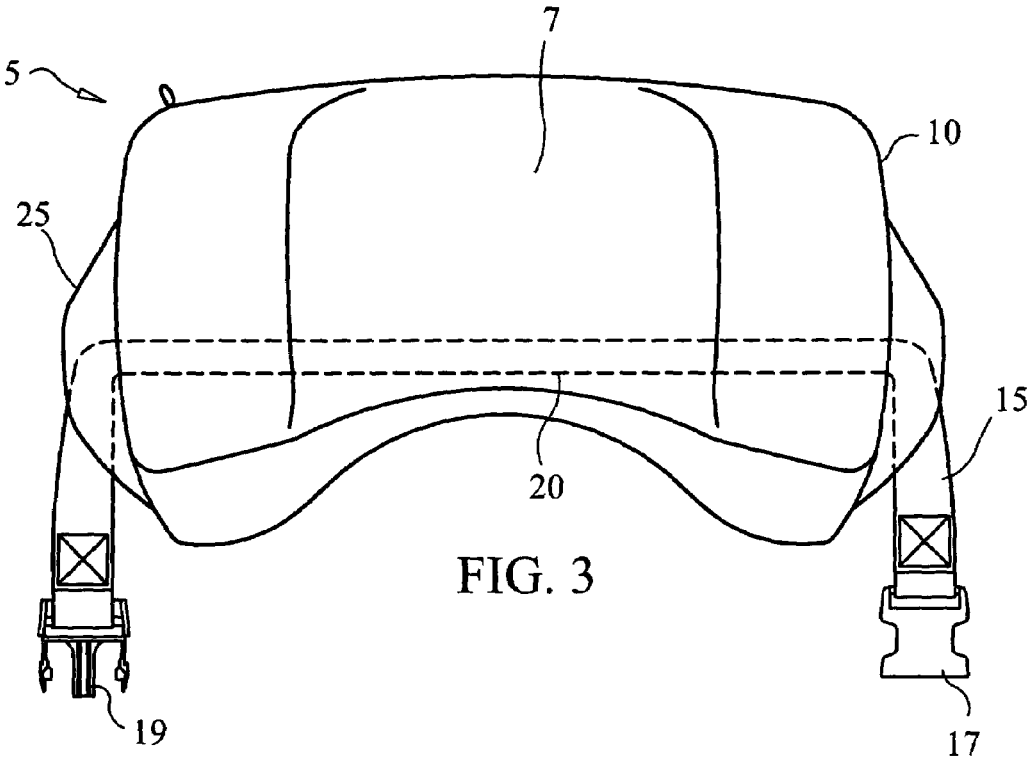
FIG. 3 is a front view of the device with a broken line indicating the position of the insert for the strap.
Figure 4:
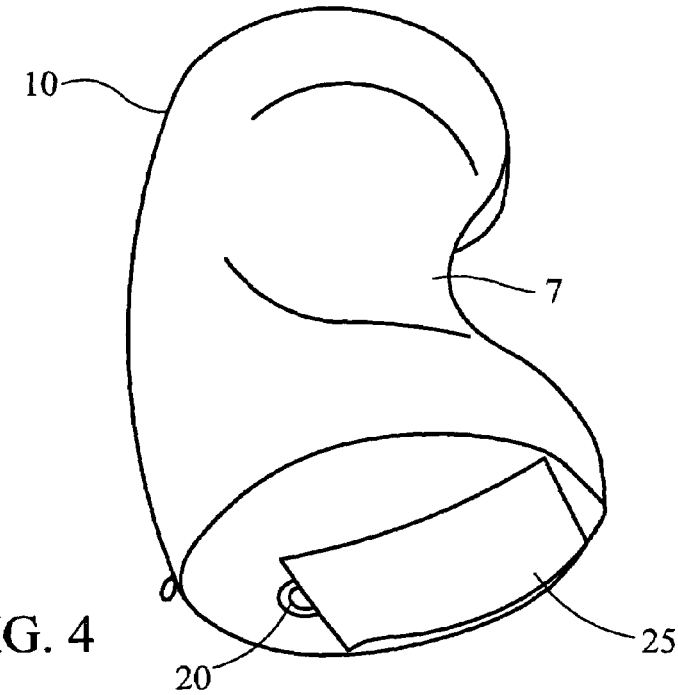
FIG. 4 is a isometric with the strap stowed in the side pocket.

An insert 20, which is mostly likely plastic is placed within this device and is larger in diameter than the strap. The strap is threaded through the device through this insert and travels or slides from one side of the device to the other. As seen in FIG. 3, the insert 20 is necessary to protect the filler material from wearing prematurely as the strap is pulled through the device.

Figure 5:
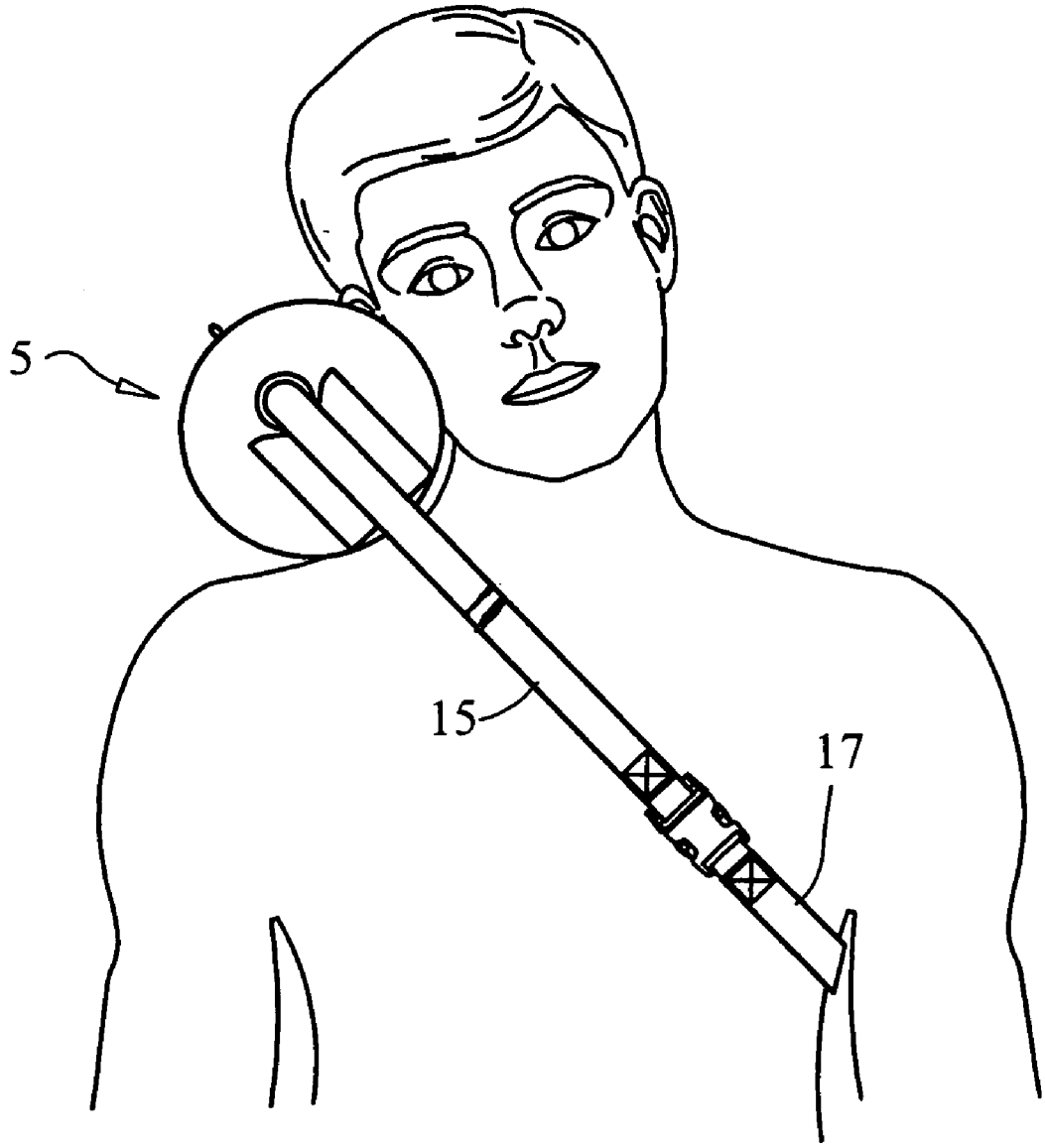
FIG. 5 is a view of the device in use on a person.

FIG. 5 is a depiction of the device. The strap 15 is adjustable in length to accommodate any size individual. Additionally, for convenience when a person travels, there is a storage pouch 25 on both sides of the device 5. The strap 15 may be coiled together and placed within the storage pouch 25 for easy transport.

The inventor claims:

1. A generally elongated pillow, adapted to be releasably attached to at least a portion of the body of user, comprising:

a. a case;

b. a filler material contained within the case;

c. as elongated strap with two ends that are adapted to be releasably connected to each other with separable fastener means;

d. an elongated insert, placed within the interior of the filler material and of a sufficient dimension to allow the strap to be slidably inserted through it; and e. at least one storage pouch, positioned on the pillow, and adapted to accommodate at least a portion of the strap.

2. The pillow of claim 1, further comprising a contoured cutout section that is slightly concave and conforms generally to the shape of a user's neck and shoulder.

3. The pillow of claim 1, wherein the filler material is foam.

4. The pillow of claim 1, wherein the filler material is air.

5. The pillow of claim 1, wherein the ends of the straps comprise separable fastener means selected from a group comprised of: male and female elements, snap fasteners, buttons, and hook and loop elements.

* * * * *